United States Patent [19]

Mansfield et al.

[11] Patent Number: 4,883,026

[45] Date of Patent: Nov. 28, 1989

[54] MEANS FOR ADJUSTING THE TIMING OF A VALVE

[75] Inventors: Wilfred P. Mansfield, late of Eastleigh; Jill Mansfield, Poole; John R. Mansfield, Kingswood; Jeremy H. Grice, Southhampton, all of United Kingdom

[73] Assignee: British Internal Combustion Engine Research Institute, Ltd., United Kingdom

[21] Appl. No.: 178,150

[22] Filed: Apr. 6, 1988

[30] Foreign Application Priority Data

Apr. 7, 1987 [GB] United Kingdom ..... 8708210
Jul. 17, 1987 [GB] United Kingdom ..... 8716862

[51] Int. Cl.[4] ..... F01L 1/18

[52] U.S. Cl. ..... 123/90.16; 123/90.2; 123/90.39

[58] Field of Search ..... 123/90.16, 90.2, 90.27, 123/90.39, 90.41, 90.42, 90.44

[56] References Cited

U.S. PATENT DOCUMENTS

| | | | |
|---|---|---|---|
| 4,249,489 | 2/1981 | Bruder et al. | 123/90.16 |
| 4,498,432 | 2/1985 | Hara et al. | 123/90.16 |
| 4,643,141 | 2/1987 | Bledsoe | 123/90.16 |
| 4,696,265 | 9/1987 | Nohira | 123/90.55 |

FOREIGN PATENT DOCUMENTS

| | | |
|---|---|---|
| 179990 | 3/1985 | European Pat. Off. . |
| 2951361 | 12/1979 | Fed. Rep. of Germany . |
| 836367 | 4/1938 | France . |

*Primary Examiner*—Charles J. Myhre
*Assistant Examiner*—Weilun Lo
*Attorney, Agent, or Firm*—Remy J. VanOphem

[57] ABSTRACT

Apparatus for adjusting the timing of a valve, particularly but not exclusively for use with a four-stroke internal combustion engine. The apparatus includes a cam, which engages a cam follower which is arranged to actuate a valve mechanism in response to rotation of the cam. The cam follower is moveable in translation relative to the axis of rotation of the cam to vary the extent of actuation of the valve in response to rotation of the cam. The cam follower is shaped so that for a part of a cycle of rotation of the cam, the line of action of the force from the cam to the follower forces the follower to move in translation. This movement is greater at low cam rotational speeds than at high cam rotational speeds and, due to the profile of the surfaces of the follower, the translational movement provides varying extents of valve actuation in dependence upon cam rotational speeds.

19 Claims, 3 Drawing Sheets

MEANS FOR ADJUSTING THE TIMING OF A VALVE

BACKGROUND OF THE INVENTION

1. FIELD OF THE INVENTION

The invention relates to means for adjusting the timing of a valve, and is particularly but not exclusively applicable to internal combustion engines in which cyclically operated gas flow valves are used.

2. DESCRIPTION OF THE PRIOR ART

In conventional internal combustion engines, the gas flow valves, for example the inlet valves and exhaust valves of a four-stroke engine, are operated by mechanisms which open and close them at fixed timings, i.e. at the same number of degrees of crankshaft rotation before or after the top or bottom dead center positions of the piston, whatever the engine speed in revolutions per unit of time.

It has long been recognized that the overall performance of engines would be improved if the valves were open for a larger part of the cycle at high engine speeds than at low engine speeds. Several mechanisms have been proposed for this purpose and some have proved effective but they are too expensive, because of the complication, for use in mass-produced engines.

With the continuous demand for further improvements in engine performance, there is a need for an inexpensive mechanism for varying the open period of valves as the engine speed changes. More specifically, the chief requirements are to make the air valves close earlier at low engine speeds and the exhaust valves open later.

SUMMARY OF THE INVENTION

According to the invention, there is provided an apparatus for adjusting the timing of a valve. The apparatus includes a cam and a cam follower arranged to actuate a valve mechanism in response to cam rotation and movable in translation relative to the axis of rotation of the cam to vary the extent of actuation.

Embodiments of the invention include a cam and a cam follower arranged to permit relative sliding movement during each engine cycle, which sliding movement alters the timing of valve events. The surfaces of the two parts are shaped in such a way that resolved parts of the contact forces produce the movement in one direction, called the outward movement, during each engine cycle.

Alternatively, other means or additional means for producing the outward movement may be provided.

Means are further provided for applying forces to control the outward movement and for producing a return movement during each engine cycle.

The design of the system may be such as to give forces sufficient to produce the full outward movement at low engine speed only, so that as the engine speed increases and the time of application of the forces diminishes, the movement and hence the effect on valve timing diminishes.

The embodiments of the invention may be combined with means for changing the angular position of the camshaft in relation to that of the crankshaft in accordance with engine speed.

Several specific embodiments of the invention will now be described by way of example with reference to the accompanying drawings.

DETAILED DESCRIPTION OF THE PREFERRED EMBODIMENT

Figure 1:
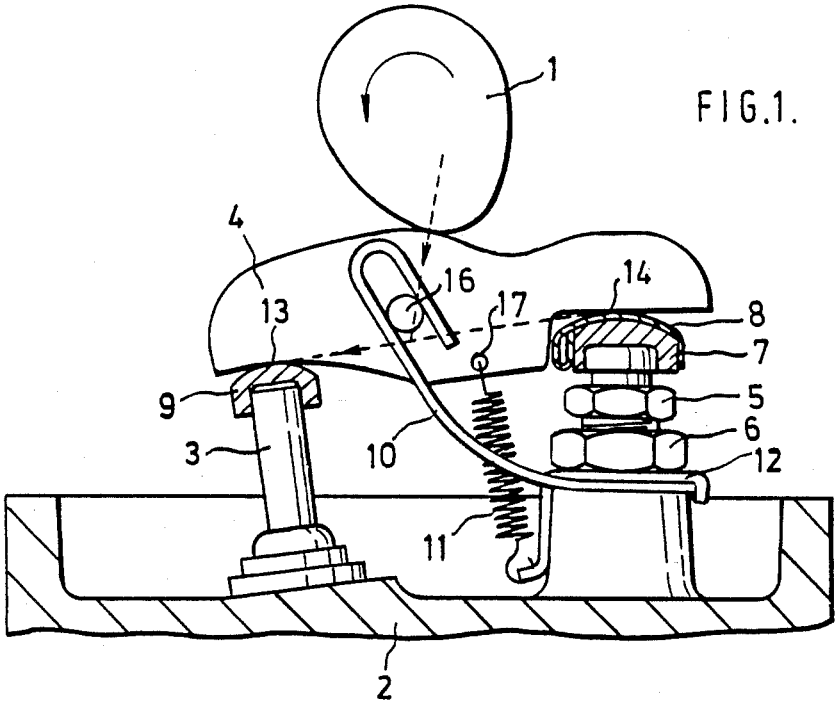
FIGS. 1 and 2 are views of a first embodiment of the invention showing two positions of a sliding lever and controlling springs used to vary the timing of the closing of an inlet valve in an engine having lever operated valves.

Referring to FIG. 1, parts of the valve gear requiring no alteration are the cam 1, of which only the contour is shown, the cylinder head 2, of which the top is shown, and the valve assembly which includes a valve spring held in place on a valve stem by means of a valve spring cap of which only the projecting end 3 of the stem is shown. New or modified parts in this embodiment are a modified lever 4 of which the outline is shown, a modified stud 5 (or hydraulic tappet) for adjusting valve clearance, (the stud 5 being shown fitted with a usual lock nut 6), the modification being the reduction of the commonly used hemispherical upper end of the stud or hydraulic tappet to a short cylindrical end, a cap 7 seating on the cylindrical end, a spring clip 8 seating on the cap 7, a valve stem cap 9, similar to those normally used in some existing arrangements, two springs 10 and 11, and a washer 12 which is clamped by the locknut 6 and has local projections which hold the lower ends of the two springs. The two caps 7 and 9 have upward projections, omitted for clarity, on both sides of the lever, as commonly used on valve caps, to prevent lateral movement of the ends of the lever 4. The spring clip 8 lies between the projections on the cap 7.

The positions of the moving parts shown in FIG. 1 are those at which the valve has begun its closing movement. The upper broken line shows the direction of the force exerted by the cam on the lever at the point of contact. The lower broken line, which connects the points of contact of the lower surfaces 13 and 14 of the lever with the upper surfaces of the valve stem cap 9 and the spring clip 8, shows the direction in which the lever is able to slide at this moment. Since the two lines are not at right angles to one another, a component of the cam force is acting in the sliding direction and the lever has begun to slide.

Figure 2:
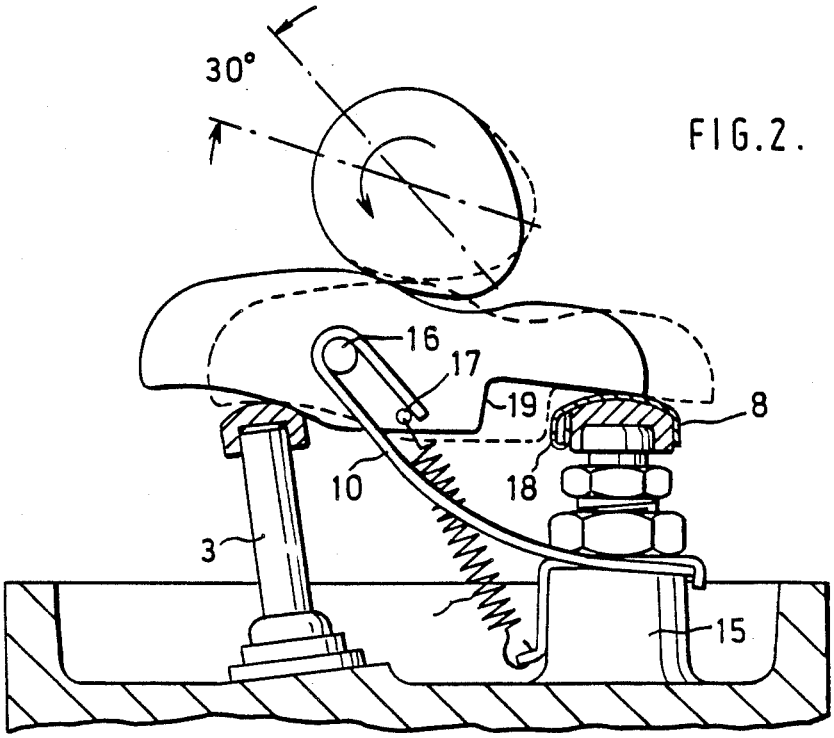

The sliding movement is limited, as shown in FIG. 2, by the double-sided spring 10 which is formed from a single length of spring wire and fits round a boss 15 on the cylinder head into which the adjusting stud 5 is screwed. The spring has loops at each end engaging projections 16 on the sides of the lever which are formed by a short length of rod press-fitted in a hole through the lever or are formed integrally on the lever. The spring offers no resistance to the movement of the lever during most of its travel but near the required end of the travel the projections reach the ends of the loops and the spring applies an increasing force to the lever bringing it to rest.

The second spring 11, which is of the coil type and is shown in outline in the two figures, serves to prevent the right-hand end of the lever from lifting, to assist in controlling the sliding movement and to pull the lever back to its starting position while the valve is closed. Its upper end is hooked into a small hole 17 in the lever. The projecting end 18 of the spring clip 8 is wider than the rest and is looped as shown to form a resilient buffer to bring the lever to rest without excessive noise when a step 19 on the lever strikes it.

The movement of the lever to the position shown in full lines in FIG. 2 occurs at low engine speeds only. The shape of the part of the upper surface of the lever with which the cam makes contact during valve opening is the same as that used with normal valve gear. The part with which the cam makes contact during valve closing is shaped so that the full sliding movement and hence the full reduction of the valve open period is produced at low engine speeds. Automatically the sliding movement is reduced as the engine speed is increased, because the nose of the cam sweeps faster across the lever surface thus applying the sliding force for a shorter period. At high engine speeds the sliding movement is negligible.

The full lines in FIG. 2 show the cam and the lever in the position at which the valve has just reached its seat at low engine speed. As in the conventional arrangement, this occurs while the ramp portion of the closing flank of the cam is in contact with the lever. The broken lines in FIG. 2 show the cam and the lever in the position at which the valve has just reached its seat at high engine speed when the sliding movement of the lever is very small. The two cam positions are 30 degrees apart. Thus the valve closes in this example 60 degrees of crankshaft rotation earlier at low engine speed than at high engine speed. This is a greater change than is required in most cases in the timing of closure of the air valve. It can easily be reduced if necessary by allowing the lever less sliding movement.

Since the valve reaches its seat after the lever has slid various distances depending on the speed of the engine, it is necessary to design the lever so that the valve clearance remains satisfactory regardless of the extent of sliding. It is convenient to make the lever surface 14 straight. The upper surface of the lever contacting the cam may next be designed to give the required period change. The shape of the lever surface 13 necessary to maintain a satisfactory valve clearance between the lever and the base circle of the cam may then be determined by calculation, by a graphical method, or by trial and error. The clearance may be made constant at its normal value at all the sliding positions of the lever. However, a clearance which increases as the lever slides to its low speed position may be provided. A substantial increase may be used which will still keep the velocity with which the valve seats at low engine speed well below its normal value at high engine speed. Such a choice will produce a greater shortening of the valve open period, with a given sliding movement of the lever, than would be obtained with a constant clearance.

In some applications, the arrangement shown in FIGS. 1 and 2 may cause excessive side thrust on the valve stem when the engine is running at low speeds. In such cases a valve spring cap may be used having a short downward cylindrical extension around the spring. A concentric arcuate surface of slightly larger radius may be provided to the left of the valve in FIGS. 1 and 2 on a projection from the cylinder head. The new bearing thus formed will reduce the outward thrust on the valve stem to a low value. Alternatively, the concentric arcuate surface could mate against the cylindrical side of the cap 9 in which case, no change in the structure of the valve spring cap need be made.

Figure 3:
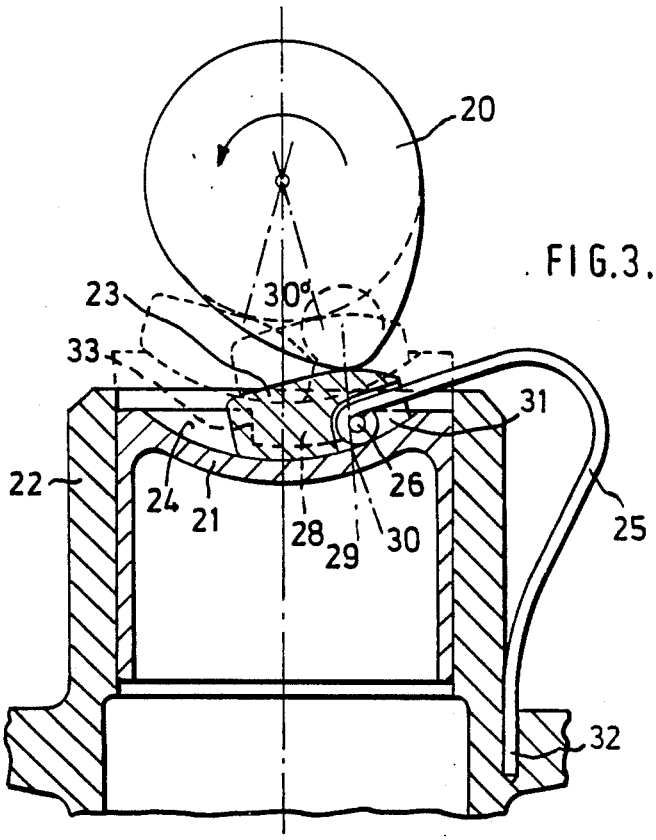
FIGS. 3 and 4 are two views of a second embodiment of the invention, being a side and plan view of a slider and controlling spring used to vary the timing of the closing of an inlet valve in an engine in which the cam actuates a piston type of follower seated on the valve stem.
Figure 4:
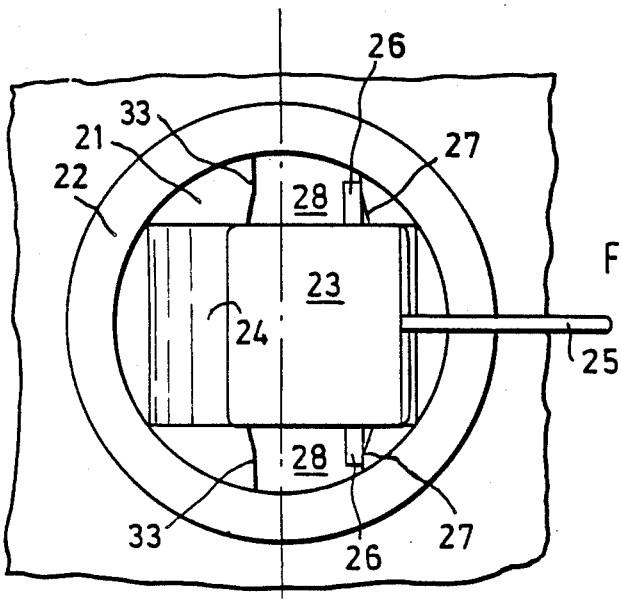

FIGS. 3 and 4 show the application of the invention to an inlet valve operating mechanism of the type in which the cam acts on a piston type of follower seated on the end of the valve stem. The valve and spring assembly are not shown as they are of conventional design.

FIG. 3 is a vertical cross-section of the mechanism but, to avoid confusion with other lines, no section lines have been drawn on the cam. Section lines have been omitted also from two components made of spring wire. FIG. 4 is a plan view of the mechanism below the cam. The arrangement includes a conventional cam 20, a modified piston type of follower 21 in a conventional housing 22, a slider 23 placed between the cam and the former follower 21 in which it slides in an arcuate recess 24, a wire spring 25 and a straight length of spring wire 26 which is pressed through a hole through the slider, securing the wire spring pivotally to the slider and projecting from both sides. In the position of the moving parts shown in full lines in the two figures, the projecting ends of the spring wire 26 are in contact with the sides 27 of recesses 28 formed in the sides of the former follower 21. The other sides of the recesses are numbered 33. In FIG. 3, part of these two sides are shown in broken line at 33 behind the slider. Both recesses are seen clearly in FIG. 4. The spring wire or projections 26 against the sides 27 of the recess prevent the slider from moving farther to the right in the figure as the nose of the cam runs across the straight part of the upper surface of the slider to open the valve. The sides 27 may be shaped as shown to allow the wire projections 26 to flex, thus reducing impact at the end of the return movement.

At low engine speeds, the action is as follows. When the contact point between the cam and the slider reaches the end of the straight line portion, the valve is fully open and the thrust on the slider in the sliding direction is zero. In the position shown in the figures, the contact point has just moved on to the curved part of the slider surface and the line of the contact force, shown as a chain line 29 in FIG. 3, now makes an angle with the short chain line 30 drawn at right angles to the surface of the arcuate recess. A resolved part of the contact force now causes the slider to commence movement to the left.

The upper end of the wire spring 25 is located in a local slot 31 in the slider. Its lower end 32 is pushed into a hole drilled alongside the outer wall of the housing 22. As the slider moves to the left, the spring at first resists its motion with very little force. The spring force increases slowly during most of the slider movement as the spring makes contact with more of the outer wall of the housing. It then increases more rapidly bringing the slider to rest. To make the requirements of the spring less exacting, the left-hand walls 33 of the recesses are so located that they too act as stops for the wire projections 26 and thus help to arrest the slider at the desired position.

At high engine speed, the limited portion of the cam surface that produces a sliding force passes so rapidly across the slider surface that it produces only a small slider movement.

The outlines of the slider shown in broken lines in FIG. 3 show the difference between the positions of the slider at valve closure at high and low engine speeds. As in the example of a lever operated mechanism, a sliding movement sufficient to shorten the valve open period by 60 degrees has been chosen.

If desired, the center of the recess arc, which is below the axis of the camshaft, may be slightly offset to the left of the centerline of the drawing in order to provide an increasing clearance between the slider and the base circle of the cam so that less sliding movement is required, as explained in connection with the arrangement shown in FIGS. 1 and 2.

Figure 5:
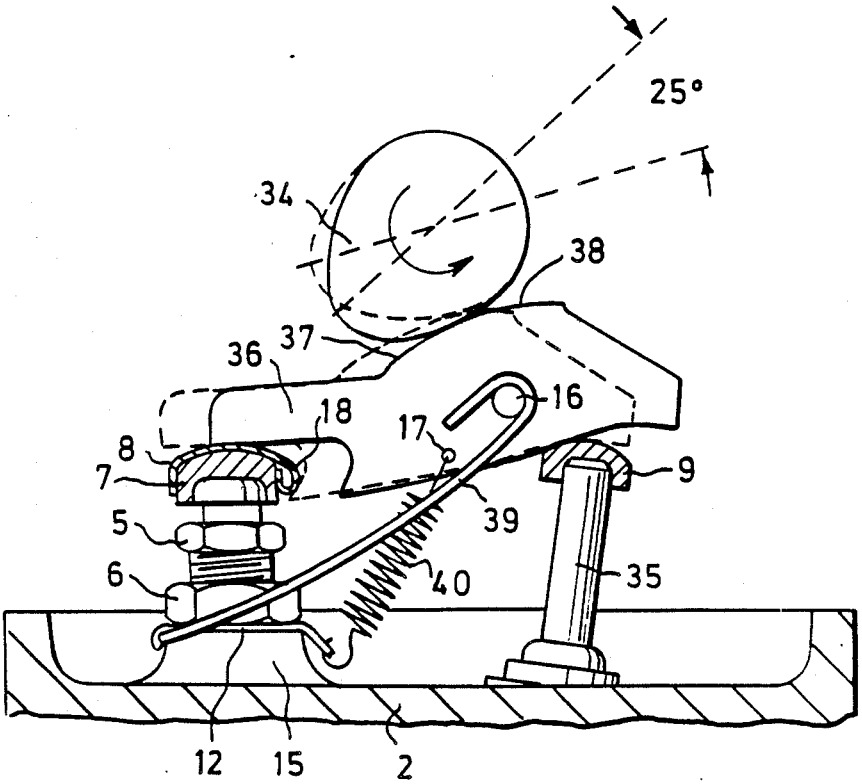
FIG. 5 is a view of a third embodiment of the invention showing a sliding lever and spring arrangement used to vary the timing of the opening of an exhaust valve.

The above examples of embodiments of the invention relate to the variation of the timing of the closing of inlet valves. FIG. 5 shows the use of the invention to vary the timing of the opening of exhaust valves in the same engine as used for the air valve application shown in FIGS. 1 and 2. These earlier figures show that in this type of single camshaft engine, the nose of the air valve cam sweeps across the contact surface of the lever away from the air valve. FIG. 5 shows that the nose of the exhaust valve cam sweeps towards the exhaust valve which is on the side of the engine opposite to the air valve.

In FIG. 5, 34 is an exhaust valve cam, 35 is an exhaust valve stem, and 36 is a sliding exhaust valve lever, the cam contacting surfaces of which are a straight portion 37 and a portion 38 which is the same as on the conventional lever, the two portions being joined smoothly by an arc, 39 is a double-sided wire spring serving to limit the sliding movement of the lever and 40 is a light return spring. The springs 39 and 40 are similar in appearance to 10 and 11 in FIG. 1 but in this application they are of different design. The parts numbered 2, 5, 6, 7, 8, 9, 12, 15, 16, 17, and 18, are all substantially the same as those in FIGS. 1 and 2 except that the boss 15 is considerably shorter.

The broken lines in FIG. 5 show the lever 36 in the position from which the sliding movement begins, and the cam 34 in the position in which it has taken up the clearance and is beginning to exert the contact force, a resolved part of which pushes the lever in the sliding direction. At low engine speeds, the inertia of the lever has little effect and the cam and the lever reach the positions shown in full lines, further movement of the lever being prevented by the double-sided spring 39. Further rotation of the cam then depresses the lever and opens the exhaust valve. At high engine speeds, the effect of the inertia of the lever is that the lever hardly moves from the position shown by the broken line before the component of the force on the lever tending to open the valve is sufficient to do so. The cam, therefore, moves almost immediately on to the portion 38 of the lever contact surface and subsequently the normal valve movement at high engine speed is obtained.

The difference between the two angular positions of the cam is 25 degrees. Hence, with the amount of sliding movement provided, the exhaust valve will open nearly 50 degrees of crank angle later at low engine speed than at high engine speed. This amount is ample in the typical case of the engine chosen for this example.

When the valve has been fully opened and begins to close at low engine speeds, the force exerted by the cam on the lever in the outward direction becomes small. The two springs 39 and 40 initiate a return movement of the lever and the spring 40 completes the return movement, so that the closure of the valve occurs at the normal timing as required.

A further problem which is known to occur in cam-cam follower mechanisms is that the hydrodynamic lubrication of the mechanism can be known to fail, due to insufficient relative velocity of cam and cam follower occuring at the tip of the cam, this causing breakdown of hydrodynamic lubrication at low speed.

In the embodiment described, at low speed, the follower has a translational movement during part of the cycle of rotation of the cam, so that for this part the relative velocity between cam and cam follower increases having regard to a translationally fixed follower mechanism. This translational movement may improve the hydrodynamic lubrication performance of the mechanism for some valves and design of the mating surfaces to provide suitable relative movement while not affecting the desired valve timing is envisaged.

In an alternative embodiment, means other than resolved parts of the contact forces to produce the outward sliding movement may be used. For example, the necessary sliding force may be provided by oil acting on a plunger bearing on the end of the lever remote from the valve in FIG. 5. A bore for the plunger is formed in a post mounted on the cylinder head, or in a projection from the wall of a casing surrounding the valve gear. A rotary distributor, of which part of the camshaft may form the rotor, is designed to apply the pressure of oil, in this case from the engine lubricating system, to the plunger via a flow path of limited flow area. The supply of oil to the plunger commences shortly before the camshaft reaches the position at which the exhaust valve has to begin opening at high engine speed. As a result of the limited oil flow rate, very little sliding movement occurs at high engine speed before valve opening begins. At low engine speed, the full outward movement of the lever is completed and the full retardation of valve opening occurs. The rotary distributon then cuts off the supply of oil and opens a discharge port, releasing oil which drains back to the oil pump. The return spring 40 in FIG. 5 is then able to bring the lever back to its starting position. The distributor serves each of the exhaust valve assemblies in turn.

Alternatively or additionally, an oil-loaded plunger contacting a suitably shaped other end of the lever may be used in place of the springs 39 and 40 to limit the outward movement and to produce the return movement.

In a further alternative embodiment, a plunger or other member which may either be coupled to or form part of the slider, may be connected to a position control device, for example a hydraulic or pneumatic ram or solenoid, the position control device being controlled by a microprocessor forming part of an engine management system. The microprocessor control system would respond to measured variables such as engine speed, load, temperature or cam position and from these measurements derive, from a look-up table, the position of the cam follower, for a desired engine operating condition, thus providing more flexible control over the valve timing.

The embodiments of the invention may be used with any means for changing the timing of the camshaft in relation to that of the crankshaft. The combination may be used in single or twin camshaft engines with any of the arrangements described for varying the timing of air valve closure or exhaust valve opening. Such a combination would preferably only be used if the further improvement in engine performance justified the additional cost.

In all the examples described, the additional relative movement between the cam and the follower is obtained by moving the follower. As an alternative, the cam may be arranged to turn on the camshaft, for example by fitting a key to the shaft and mounting on it a separate cam with a wider keyway allowing it the required amount of turning movement controlled, in accordance with the invention, by contact forces, a return spring and buffers.

According to the invention in a further aspect, there is provided means for transmitting an applied movement to a valve during an opening and closing cycle thereof and wherein the transmitting means is arranged to vary the timing, within said cycle, of transmission of the movement in dependence upon the speed of the movement as applied to the transmission means.

We claim:

1. Apparatus for adjusting the timing of a valve mechanism, said apparatus comprising:

a cam rotatable about an axis of rotation;

a cam follower arranged to actuate a valve mechanism in response to the rotation of said cam and moveable in translation relative to said axis of rotation of said cam and in lateral translation relative to the direction of actuation of said valve mechanism to vary the extent of actuation, said cam follower having a cam following surface engaged by said cam and a valve actuation surface engaging said valve mechanism, said cam following and valve actuation surfaces providing different extents of actuation, of the valve mechanism for a given cam position, for different translational positions of said cam follower and wherein said cam follower surface is shaped so that for a part of the cycle of rotation of said cam, the force generated by said cam on said cam follower urges said cam follower to move in said lateral translation relative to the direction of actuation of said valve mechanism.

2. Apparatus as claimed in claim 1 wherein said cam follower surface and said valve actuation surface are so shaped as to provide the same clearance between the base circle of said cam and said cam follower for different translational positions of said cam follower.

3. Apparatus as claimed in claim 1 wherein said cam follower comprises a lever engaging a pivot, said lever being slidable relative to said pivot, cam and valve mechanism and rotatable about said pivot to provide said valve actuation.

4. Apparatus as claimed in claim 1 wherein said cam follower and a component of the valve mechanism have complementary arcuate surfaces for relative translational sliding motion.

5. Apparatus as claimed in claim 1 further comprising means for limiting the translational movement of said cam follower.

6. Apparatus as claimed in claim 4 further comprising means for limiting the translational movement of said cam follower, which means includes a pin which projects into and is movable within a slot, one of said pin and slot being part of said cam follower and the other being part of the valve mechanism.

7. Apparatus as claimed in claim 6 wherein said slot has at least one end portion which slants relative to the direction of pin projection.

8. Apparatus as claimed in claim 1 further comprising means for biasing said cam follower against said translational movement.

9. Apparatus as claimed in claim 8 wherein, said biasing means comprises a spring.

10. Apparatus as claimed in claim 8 wherein said biasing means comprises an oil loaded plunger.

11. Apparatus as claimed in claim 1 further comprising a member engaging said cam follower and control means for controlling the position of said member.

12. Apparatus as claimed in claim 11 wherein said control means comprises a solenoid.

13. Apparatus as claimed in claim 11 wherein said control means comprises a fluidic ram.

14. Apparatus as claimed in claim 11 wherein said control means receives control instructions from a digital system for controlling the operations of the device of which said valve mechanism forms part.

15. Apparatus as claimed in claim 1 wherein said cam follower is arranged to actuate said valve mechanism to reduce said open time of the valve mechanism at a low cam rotation speed with respect to a high cam rotation speed.

16. An internal combustion engine including apparatus as claimed in claim 1.

17. An internal combustion engine having at least one cylinder, an exhaust valve and an inlet valve being associated with said at least one cylinder, a cam and a cam follower arranged to actuate each of said exhaust valve and said inlet valve and wherein at least one cam follower is moveable in translation relative to the axis of rotation of its respective cam and in lateral translation relative to the direction of actuation of its respective valve to vary the extent of actuation of its respective valve, said at least one cam follower having a cam following surface engaged by a respective cam and a valve actuation surface engaging said respective valve, said cam following and valve actuation surfaces providing different extents of valve actuation, for a given cam position, for different translational positions of said cam follower and wherein said cam follower surface is shaped so that for a part of a cycle of rotation of said cam, the force generated by said cam on said cam follower urges said cam to move in said lateral translation relative to the direction of actuation of its respective valve.

18. An internal combustion engine as claimed in claim 20 wherein said translationally moveable cam follower is associated with said inlet valve and said cam follower is arranged to actuate said inlet valve so that said inlet valve closes earlier at lower engine speeds with respect to higher engine speeds.

19. An internal combustion engine as claimed in claim 17 wherein said translationally moveable cam follower is associated with said exhaust valve and said cam follower is arranged to actuate said exhaust valve so that said exhaust valve opens later at lower engine speeds with respect to higher engine speeds.

* * * * *

UNITED STATES PATENT AND TRADEMARK OFFICE

CERTIFICATE OF CORRECTION

PATENT NO. : 4,883,026

DATED : November 28, 1989

INVENTOR(S) : Wilfred Mansfield

It is certified that error appears in the above-identified patent and that said Letters Patent is hereby corrected as shown below:

Column 7, line 16, delete "said" and insert ---- the ----.

Column 8, line 2, delete "the" and insert ---- said ----.

Column 8, line 53, delete "20" and insert ---- 17 ----.

Signed and Sealed this

Sixteenth Day of April, 1991

*Attest:*

HARRY F. MANBECK, JR.

*Attesting Officer*

*Commissioner of Patents and Trademarks*